US007395688B2

(12) United States Patent
Murayama

(10) Patent No.: US 7,395,688 B2
(45) Date of Patent: Jul. 8, 2008

(54) HOG RING FASTENING DEVICE

(75) Inventor: Takashi Murayama, Hachioji (JP)

(73) Assignee: Meihotech Inc., Tokyo (JP)

( * ) Notice: Subject to any disclaimer, the term of this patent is extended or adjusted under 35 U.S.C. 154(b) by 413 days.

(21) Appl. No.: 11/283,905

(22) Filed: Nov. 22, 2005

(65) Prior Publication Data

US 2006/0112891 A1 Jun. 1, 2006

(30) Foreign Application Priority Data

Nov. 30, 2004 (JP) ..... 2004-345201

(51) Int. Cl.
*B25C 5/13* (2006.01)

(52) U.S. Cl. ..... 72/453.01; 72/453.16; 72/409.03; 72/424; 29/243.56; 29/816

(58) Field of Classification Search ..... 72/453.02, 72/453.01, 453.16, 424, 409.03; 29/243.56, 29/816, 818; 226/143, 151, 167, 162; 227/120, 227/130, 132, 138; 53/138.4
See application file for complete search history.

(56) References Cited

U.S. PATENT DOCUMENTS 2,539,313 A * 1/1951 Miller ..... 72/424
5,123,273 A * 6/1992 Kawabata ..... 72/409.03
5,483,815 A * 1/1996 West ..... 72/452.8
5,709,124 A * 1/1998 Murayama ..... 72/409.03
5,979,213 A * 11/1999 Toyoda ..... 72/409.02
6,035,690 A * 3/2000 Murayama ..... 72/409.02

FOREIGN PATENT DOCUMENTS

JP 8-216049 A 8/1996

* cited by examiner

*Primary Examiner*—Daniel C Crane
(74) *Attorney, Agent, or Firm*—Birch, Stewart, Kolasch & Birch, LLP

(57) ABSTRACT

A hog ring fastening device includes a body member, a main pneumatic cylinder attached to the body member, a first swing member supported for turning on the body member, a push means supported on the first swing member, a feed pneumatic cylinder fixed to the first swing member and connected to a port of the main pneumatic cylinder, a second swing member supported for turning on the body member so as to be in contact with the free end of the piston rod included in the feed pneumatic cylinder, a feed means supported on the second swing member, a spring seat fixed to the body member, a compression spring extended between the spring seat and the first swing member, and an extension spring extended between the first and the second swing member.

8 Claims, 8 Drawing Sheets

HOG RING FASTENING DEVICE

BACKGROUND OF THE INVENTION

1. Field of the Invention

The present invention relates to a hog ring fastening device, such as a C ring fastening device.

2. Description of the Related Art

In a conventional C ring fastening device, jaws are turned by a main pneumatic cylinder, a feed pneumatic cylinder is attached to a body member, air discharged from the main pneumatic cylinder is supplied to the feed pneumatic cylinder, a feed member is mounted on and linked by a one-way clutch to the piston rod of the feed pneumatic cylinder, and the feed member is positioned so as to be in contact with a C ring strip loaded on a magazine.

The feed pneumatic cylinder drives the feed member to feed the C rings loaded on the magazine to a fastening position.

In some cases, this C ring fastening device cannot feed the top C ring of the C ring strip to the fastening position with reliability because the feed member does not push the C ring strip in a feed direction toward the fastening position after the feed member has completed feeding the C ring strip.

SUMMARY OF THE INVENTION

Accordingly, it is an object of the present invention to provide a hog ring fastening device capable of surely feeding the top hog ring of a hog ring strip to a fastening position.

A hog ring fastening device in one aspect of the present invention includes: a body member; a magazine attached to the body member; jaws pivotally supported on the body member; a main pneumatic cylinder for turning the jaws; a first swing member supported for turning on the body member; a push means supported on the first swing member; a feed pneumatic cylinder fixed to the first swing member and connected to a port of the main pneumatic cylinder; a second swing member supported for turning on the body member so as to be in contact with a free end of a piston rod included in the feed pneumatic cylinder; a feed means supported on the second swing member; a spring seat fixed to the body member; a compression spring extended between the spring seat and the first swing member; and an extension spring extended between the first and the second swing member.

In this hog ring fastening device of the present invention, the push means pushes a hog ring strip loaded on the magazine in the feed direction after the feed means has completed feeding the hog ring strip. Consequently, the top hog ring of the hog ring strip can be surely fed to a fastening position.

BRIEF DESCRIPTION OF THE DRAWINGS

The above and other objects, features and advantages of the present invention will become apparent from the following description taken in connection with the accompanying drawings, in which.

DESCRIPTION OF THE PREFERRED EMBODIMENTS

Figure 1:
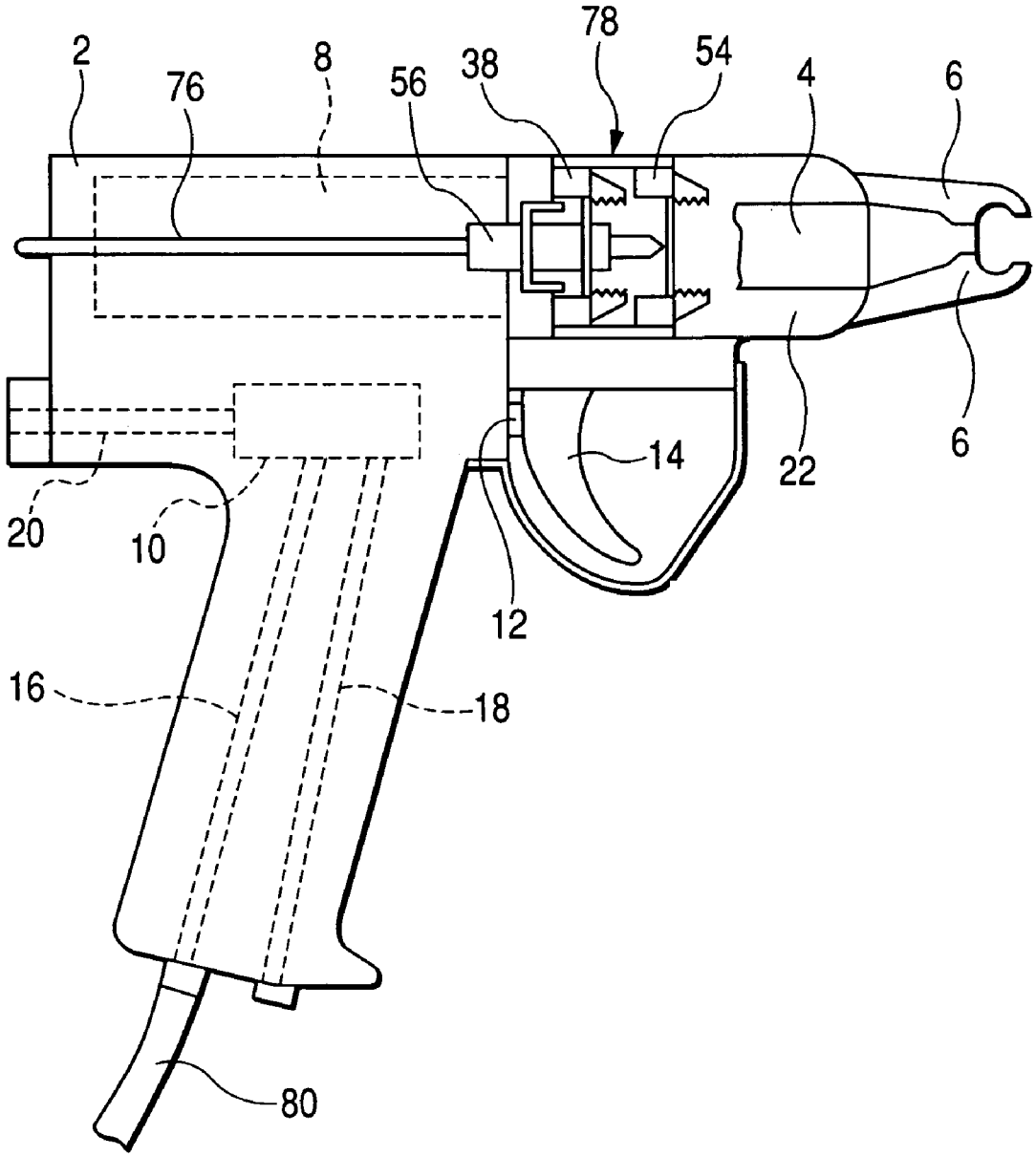
FIG. 1 is a schematic side elevation of a C ring fastening device in a first embodiment according to the present invention.
Figure 2:
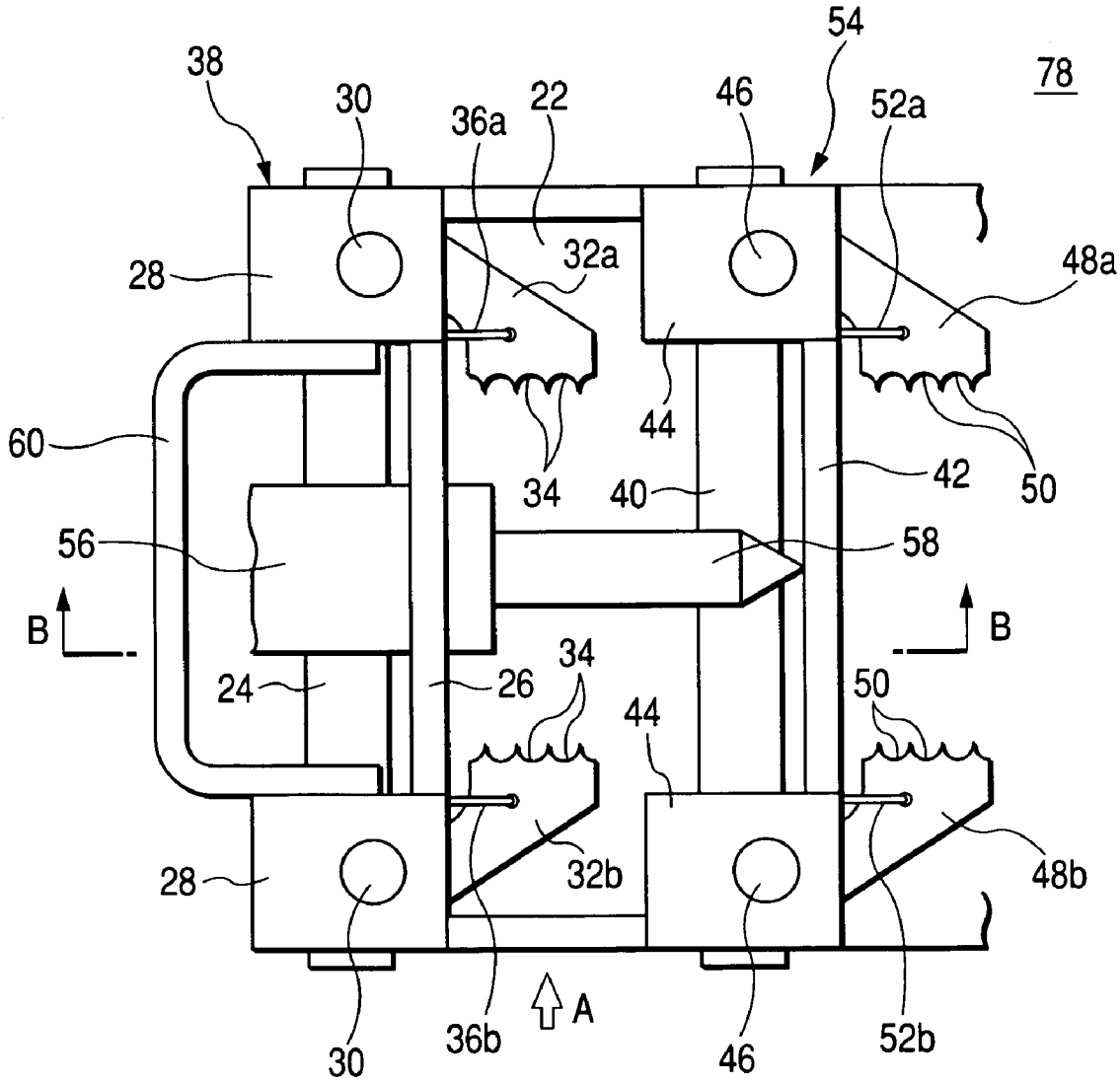
FIG. 2 is an enlarged fragmentary side elevation of a part of the C ring fastening device shown in FIG. 1.
Figure 3:
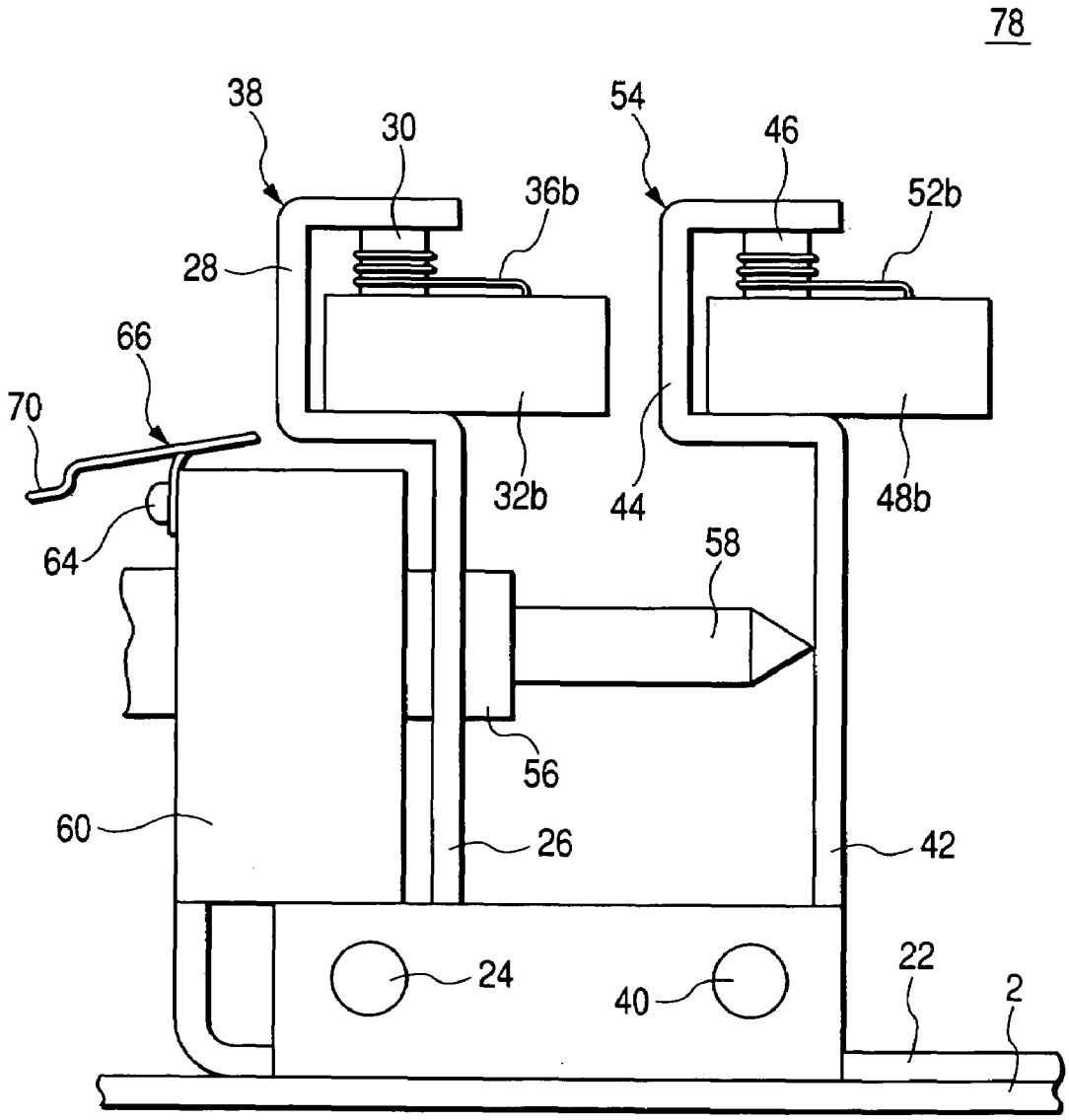
FIG. 3 is a fragmentary side elevation taken in the direction of the arrow A in FIG. 2.
Figure 4:
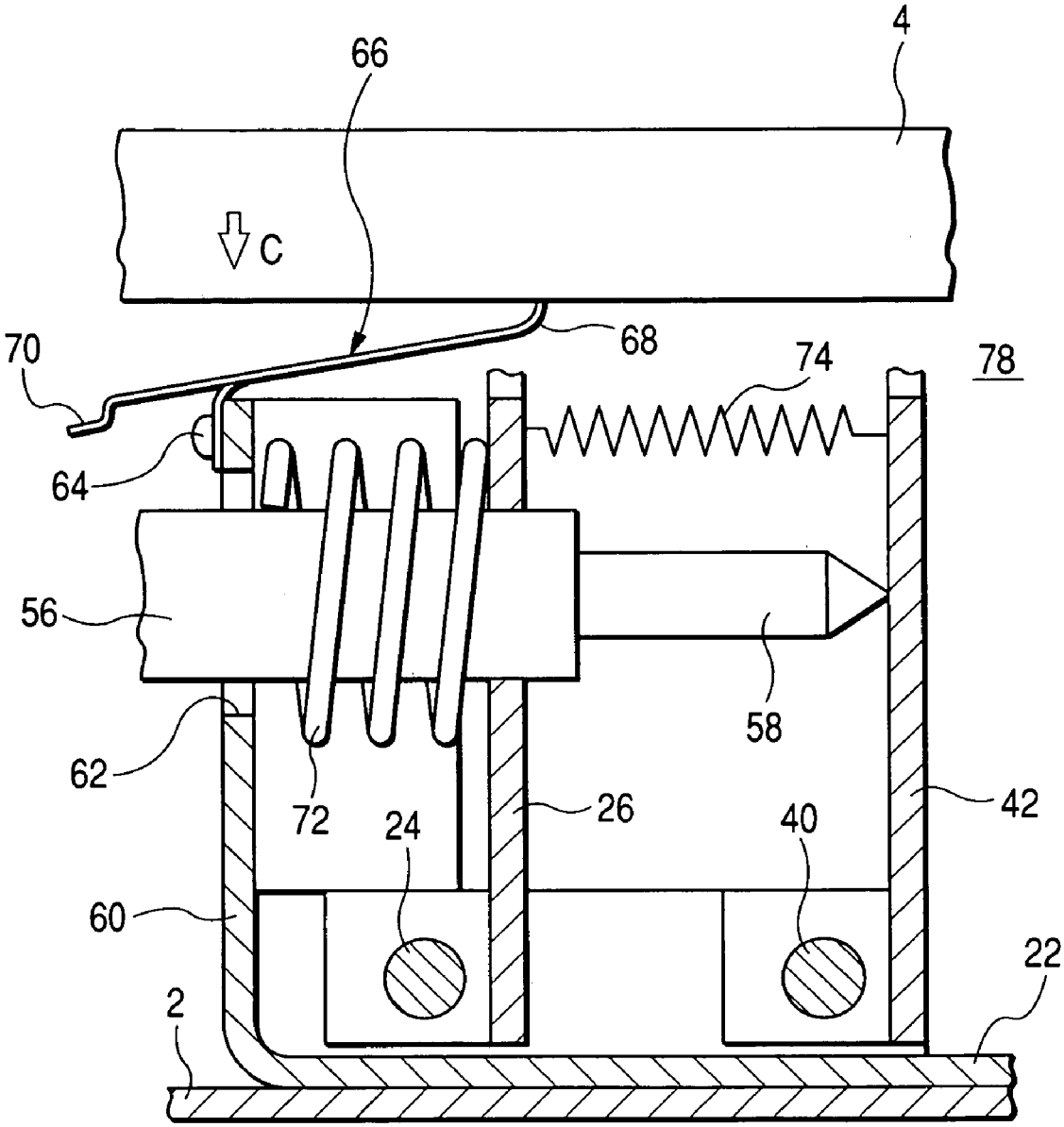
FIG. 4 is a fragmentary sectional view taken on the line B-B in FIG. 2.
Figure 5:
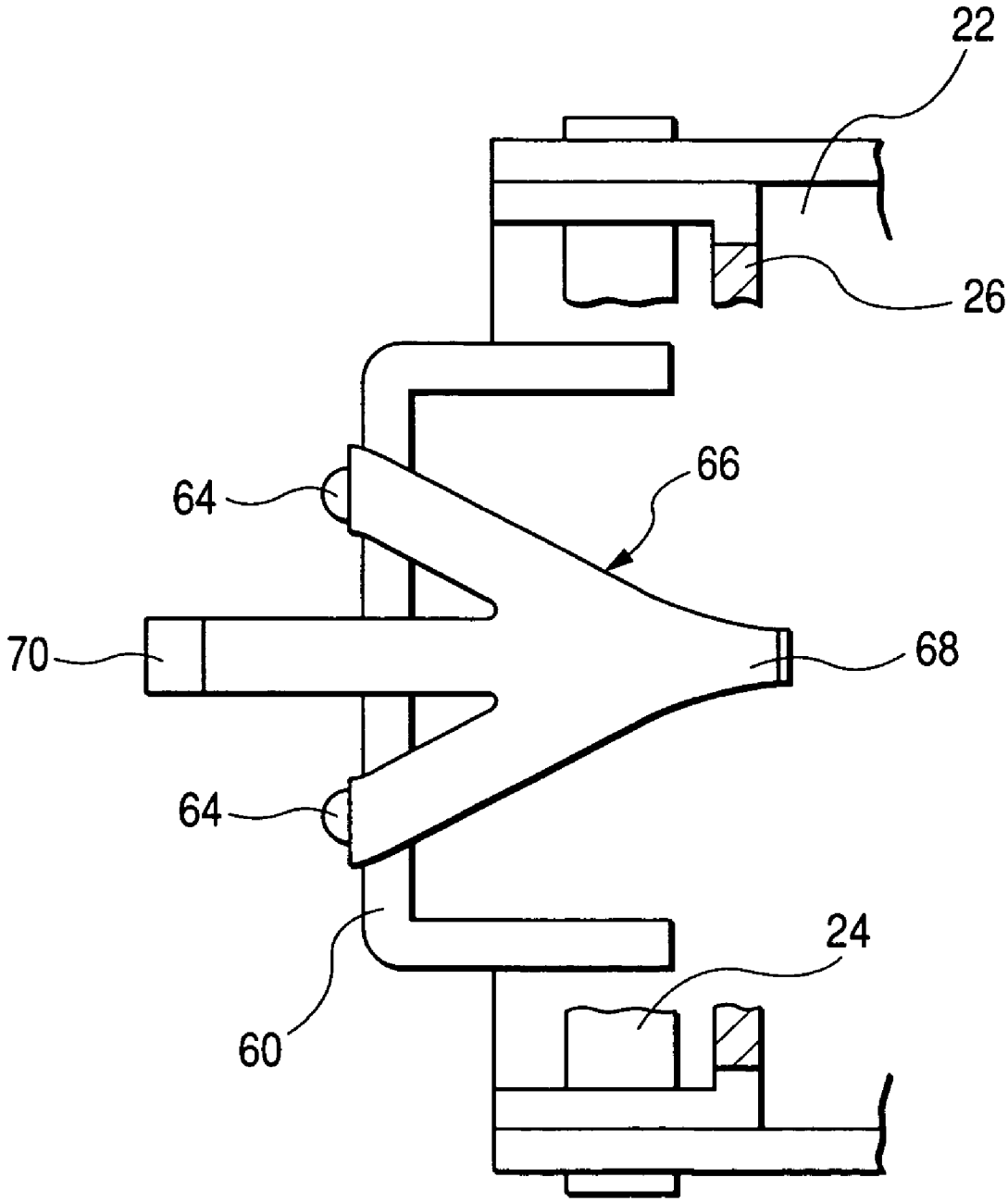
FIG. 5 is a view taken in the direction of the arrow C in FIG. 4.

A C ring fastening device in a first embodiment according to the present invention will be described with reference to FIGS. 1 to 5. The C ring fastening device has a body member 2, a magazine 4 for loading a C ring strip (described below) attached to the body member 2. Jaws 6 are pivotally supported on the body member 2. The jaws 6 deform a C ring (described below). A main pneumatic cylinder 8 for turning the jaws 6 is mounted on the body member 2. When the piston rod of the main pneumatic cylinder 8 is moved forward to the jaws 6, a jaw driving mechanism, not shown, turns the jaws 6 away from each other. When the piston rod of the main pneumatic cylinder 8 is moved back ward, the jaw driving mechanism turns the jaws 6 toward each other. A push-button directional control valve 10 provided with a push button 12 is mounted on the main body 2. The push button 12 protrudes from the main body 2. The C ring fastening device is provided with a trigger 14 for depressing the push button 12. An air supply passage 16 formed in the main body 2 is connected to the air supply port of the directional control valve 10. An air hose 80 has one end connected to the inlet of the air supply passage 16 and the other end capable of being connected to a compressed air supply device, not shown. Discharge passages 18 and 20 formed in the body member 2 are connected to the discharge ports of the directional control valve 10.

A base plate 22 is attached to the main body 2. A rotating shaft 24 is supported for rotation on the base plate 22 with its axis extended at right angles to a feed direction. A first swing member 26 is fixedly mounted on the rotating shaft 24. Thus, the first swing member 26 is able to swing on the main body 2. The first swing member 26 has a base part fixed to the rotating shaft 24 and free end parts serving as push member holding parts 28. Support shafts 30 are attached to the push member holding parts 28 with their axes extended at right angles to the axis of the rotating shaft 24. Push members 32*a* and 32*b* are supported for turning on the support shafts 30, respectively. Thus, the push members 32*a* and 32*b* are able to turn on the push member holding parts 28. The push members 32*a* and 32*b* constitute a push means. Each of the push members 32*a* and 32*b* is provided with a plurality of grooves 34 extending parallel to the axis of the support shaft 30. Side parts of a C ring can be engaged in the grooves 34, respectively. Surfaces provided with the grooves 34 of the push members 32*a* and 32*b* lie on the inner side of the axes of the corresponding support shafts 30, respectively; that is, the surface provided with the grooves 34 of the push member 32*a* is on the side of the push member 32*b*, i.e., on the lower side, as viewed in FIG. 2, with respect to the axis of the corresponding support shaft 30, and the surface provided with the grooves 34 of the push member 32*b* is on the side of the push member 32*a*, i.e., on the upper side, as viewed in FIG. 2, with respect to the axis of the corresponding support shaft 30. The surfaces provided with the grooves 34 of the push members 32*a* and 32*b* are displaced in the feed direction, i.e., to the right, as viewed in FIG. 2, from a position corresponding to the axes of the support shafts 30. The push members 32*a* and 32*b* are energized by torsion coil springs 36*a* and 36*b* so as to turn clockwise and counterclockwise, as viewed in FIG. 2, respectively. The torsion coil spring 36*a* has one end engaged with the push member holding part 28 and the other end engaged with the push member 32*a*. The torsion coil spring 36*b* has one end engaged with the push member holding part 28 and the other end engaged with the push member 32*b*. Thus, the torsion coil springs 36*a* and 36*b* energize the push members 32*a* and 32*b*, respectively, so as to turn toward each other. The sing member 26, the push members 32*a* and 32*b* constitute a push mechanism 38.

A rotating shaft 40 is supported for rotation on the base plate 22 with its axis extended at right angles to the feed direction. A second swing member 42 is fixedly mounted on the rotating shaft 40. Thus, the second swing member 42 is able to swing on the main body 2. The second swing member 42 has a base part fixed to the rotating shaft 40 and free end parts serving as feed member holding parts 44. Support shafts 46 are attached to the feed member holding parts 44 with their axes extended at right angles to the axis of the rotating shaft 40. Feed members 48*a* and 48*b* are supported for turning on the support shafts 46 respectively. Thus, the feed members 48*a* and 48*b* are able to turn on the feed member holding parts 44. The feed members 48*a* and 48*b* constitute a feed means. Each of the feed members 48*a* and 48*b* is provided with a plurality of grooves 50 extending parallel to the axis of the support shaft 46. Side parts of a C ring can be engaged in the grooves 50, respectively. Surfaces provided with the grooves 50 of the feed members 48*a* and 48*b* lie on the inner side of the axes of the corresponding support shafts 46, respectively; that is, the surface provided with the grooves 50 of the feed member 48*a* is on the side of the feed member 48*b*, i.e., on the lower side, as viewed in FIG. 2, with respect to the axis of the corresponding support shaft 46, and the surface provided with the grooves 50 of the feed member 48*b* is on the side of the feed member 48*a*, i.e., on the upper side, as viewed in FIG. 2, with respect to the axis of the corresponding support shaft 46. The surfaces provided with the grooves 50 of the feed members 48*a* and 48*b* are displaced in the feed direction, i.e., to the right, as viewed in FIG. 2, from a position corresponding to the axes of the support shafts 46. The feed members 48*a* and 48*b* are energized by torsion coil springs 52*a* and 52*b* so as to turn clockwise and counterclockwise, as viewed in FIG. 2, respectively. The torsion coil spring 52*a* has one end engaged with the feed member holding part 44 and the other end engaged with the feed member 48*a*. The torsion coil spring 52*b* has one end engaged with the feed member holding part 44 and the other end engaged with the feed member 48*b*. Thus, the torsion coil springs 52*a* and 52*b* energize the feed members 48*a* and 48*b*, respectively, so as to turn toward each other. The swing member 42, the feed members 48*a* and 48*b* constitute a feed mechanism 54.

A feed pneumatic cylinder 56 is attached to the swing member 26. The free end of the piston rod 58 of the feed pneumatic cylinder 56 is in contact with the second swing member 42. A spring seat 60 provided with an opening 62 is formed integrally with the base plate 22. The base plate 22 and the spring seat 60 are at right angles. Thus, the spring seat 60 is fixed to the body member 2. The feed pneumatic cylinder 56 is extended through the opening 62 of the spring seat 60. A port 8*a* of the main pneumatic cylinder 8 is connected to the feed pneumatic cylinder 56 by an air hose 76 (described below). A compression spring 72 is extended between the spring seat 60 and the first swing member 26. An extension spring 74 is extended between the first swing member 26 and the second swing member 42. A stopper 66 made of a stainless steel is fastened to the spring seat 60 with screws 64. The stopper 66 has a stopping part 68 and a releasing part 70. In a state shown in FIG. 4, the stopping part 68 is pressed against the magazine 4. The push mechanism 38, the feed mechanism 54 and the feed pneumatic cylinder 56 constitute a feed device 78.

Figure 6:
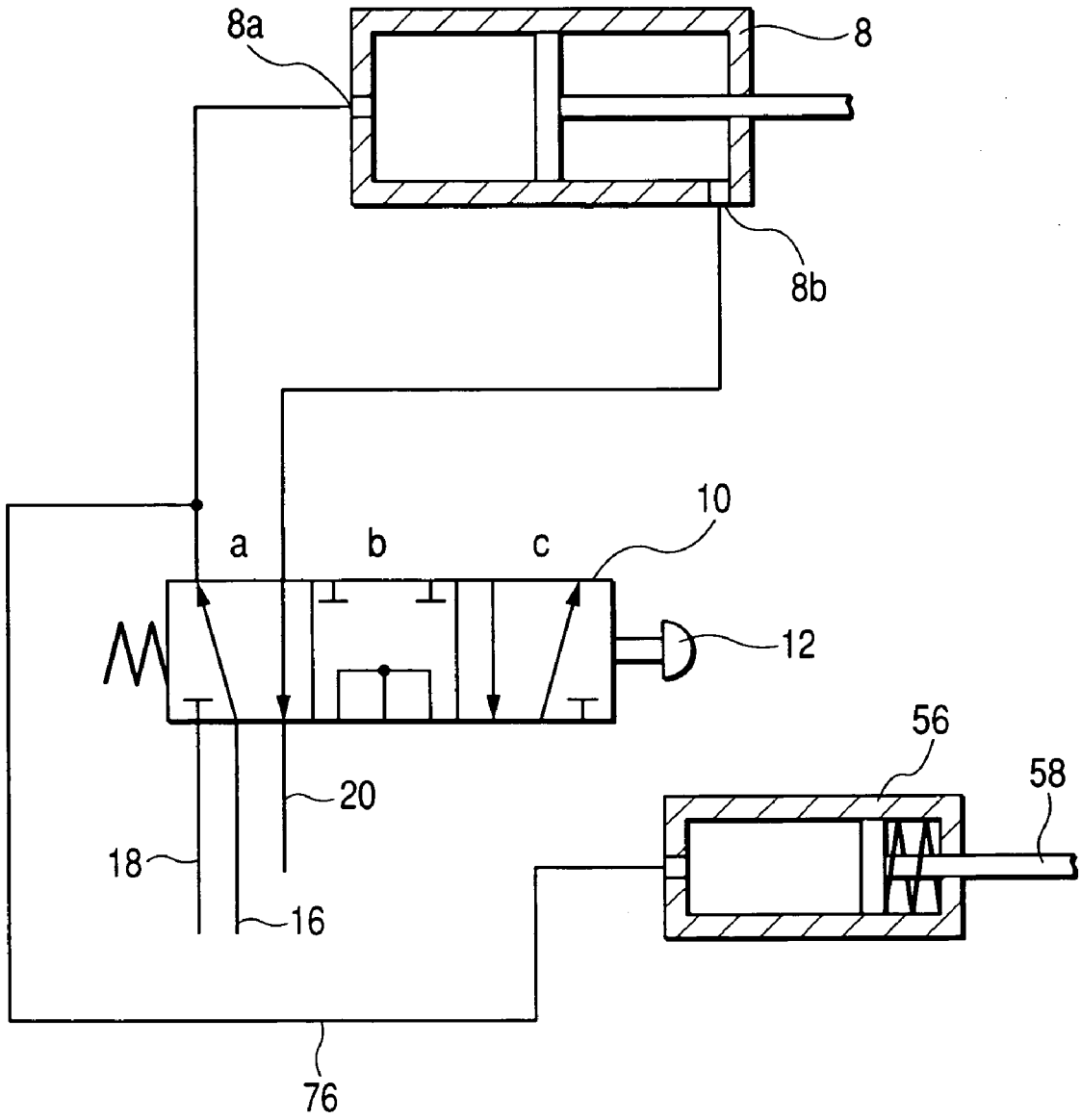
FIG. 6 is a circuit diagram of a pneumatic circuit for operating pneumatic cylinders included in the C ring fastening device shown in FIG. 1.

A pneumatic circuit for operating the main pneumatic cylinder 8 and the feed pneumatic cylinder 56 of the C ring fastening device shown in FIGS. 1 to 5 will be described with reference to FIG. 6. In a state where the directional control valve 10 is set in a position a, the ports 8*a* and 8*b* of the main pneumatic cylinder 8 are connected to the air supply passage 16 and the air discharge passage 20, respectively. In a state where the directional control valve 10 is set in a position b, the air supply passage 16, and the air discharge passages 18 and 20 are connected. In a state where the directional control valve 10 is set in a position c, the ports 8*a* and 8*b* of the main pneumatic cylinder 8 are connected to the air discharge passage 18 and the air supply passage 16, respectively.

Figure 7:
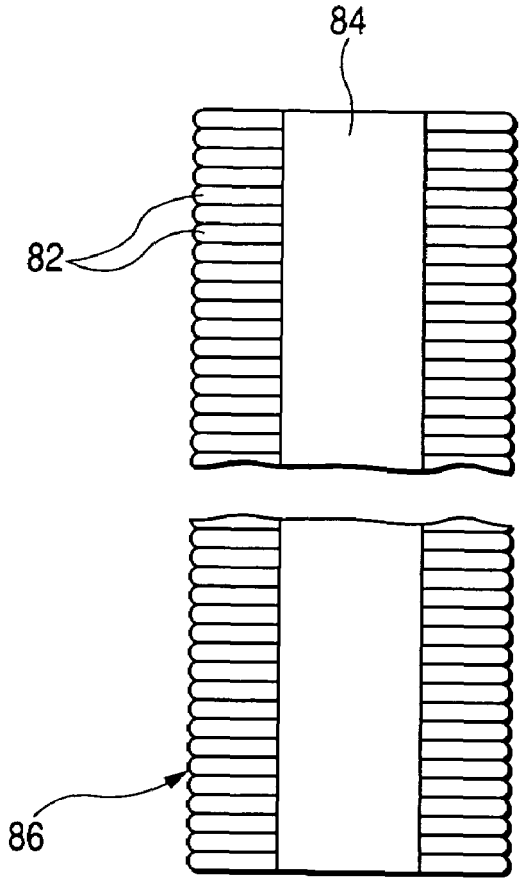
FIG. 7 is a plan view of a C ring strip.
Figure 8:
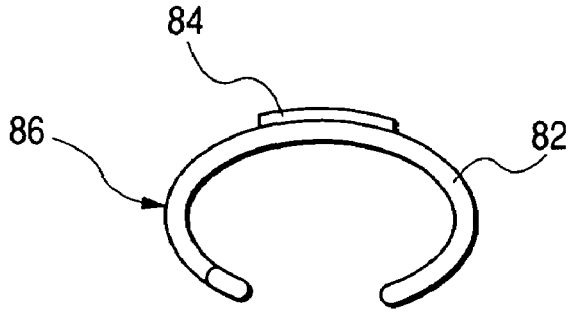
FIG. 8 is a front elevation of the C ring strip shown in FIG. 7.

The C ring strip to be used by the C ring fastening device shown in FIGS. 1 to 5 will be described with reference to FIGS. 7 and 8. A plurality of C rings 82 are arranged contiguously in a row, and adhesive tape 84 is attached to the backs of the C rings to form a C ring strip 86.

In the C ring fastening device, in case where the C ring strip 86 is loaded on the magazine 4, and the trigger 14 is pulled, the jaws 6 deform the C ring 82 for a fastening effect. In a state where the air hose 80 is connected to the compressed air supply device and the trigger 14 is not pulled, the directional control valve 10 is in the position a to supply compressed air to the port 8*a* of the main pneumatic cylinder 8. Consequently, the piston rod of the main pneumatic cylinder 8 is moved forward to turn the jaws 6 away from each other. When the trigger 14 is pulled in this state, the directional control valve 10 is set in the position c to make compressed air supplied by the compressed air supply device flow through the port 8*b* into the main pneumatic cylinder 8. Consequently, the piston rod of the main pneumatic cylinder 8 is moved backward and the jaws 6 are turned toward each other to deform a C ring 82. The deformed C ring 82 fastens members together. When the trigger 14 is released in this state, the position of the directional control valve 10 is changed from the position c via the position b to the position a. Consequently, compressed air supplied by the compressed air supply device flows through the port 8*a* into the main pneumatic cylinder 8, the piston rod of the main pneumatic cylinder 8 is moved forward to turn the jaws 6 away from each other. Thus, a fastening cycle is completed.

In a state where the magazine 4 is loaded with the C ring strip 86, the push members 32*a* and 32*b* are energized by the torsion coil springs 36*a* and 36*b*, respectively, and the feed members 48*a* and 48*b* are energized by the torsion coil springs 52*a* and 52*b*, respectively. Therefore, opposite side parts of the C rings 82 are engages in the grooves 34 of the push members 32*a* and 32*b* and the grooves 50 of the feed members 48*a* and 48*b*, respectively. When the trigger 14 is released and the directional control valve 10 is set in the position a, compressed air is supplied to the feed pneumatic cylinder 56 to move the piston rod 58 forward. Consequently, the second swing member 42 is turned clockwise, as viewed in FIG. 4, against the resilience of the extension spring 74. The feed members 48*a* and 48*b* do not turn and the feed members 48*a* and 48*b* feeds the C ring strip 86 in the feed direction because opposite side parts of the C rings 82 are engaged in the grooves 50 of the feed members 48*a* and 48*b*, and the surfaces provided with the grooves 50 of the feed members 48*a* and 48*b* are on the inner side of the axes of the support shafts 46 and are displaced in the feed direction from the position corresponding to the axes of the support shafts 46. The first swing member 26 turns clockwise, as viewed in FIG. 4, and the push members 32*a* and 32*b* are moved in the feed direction when the C ring strip 86 is fed because the first swing member 26 is pushed forward by the compression spring 72. When the C ring strip 86 is moved in the feed direction by a distance corresponding to the thickness of the C rings 82, the second swing member 42 is unable to turn. When the piston rod 58 is moved further forward, the first swing member 26 is turned counterclockwise, as viewed in FIG. 4, against the resilience of the compression spring 72 and the push members 32*a* and 32*b* are moved in a backward direction, namely, a direction opposite the feed direction. Since the surfaces provided with the grooves 34 of the push members 32*a* and 32*b* are on the inner side of the axes of the support shafts 30 and are displaced in the feed direction from the position corresponding to the axes of the support shafts 30, the push members 32*a* and 32*b* turn against the resilience of the torsion coil springs 36*a* and 36*b*.

When the trigger 14 is pulled in this state, the position of the directional control valve 10 changes from the position a via the position b to the position c to connect the feed pneumatic cylinder 56 to the air discharge passage 18. Consequently, the piston rod 58 of the feed pneumatic cylinder 56 is retracted, the second swing member 42 is pulled by the extension spring 74 and turns counterclockwise, as viewed in FIG. 4, and the feed members 48*a* and 48*b* are moved in the backward direction opposite the feed direction. Since the surfaces provided with the grooves 50 of the feed members 48*a* and 48*b* lie on the inner side of the axes of the corresponding support shafts 46, respectively, and a red is placed in the feed direction from a position corresponding to the axes of the support shafts 46, the feed members 48*a* and 48*b* turn against the resilience of the torsion coil springs 52*a* and 52*b*. In this state, the compression spring 72 applies pressure to the first swing member 26, side parts of the C rings 82 are engaged in the grooves 34 of the push members 32*a* and 32*b*, and the surfaces provided with the grooves 34 of the push members 32*a* and 32*b* are on the inner side of the axes of the corresponding support shafts 46, respectively and are displaced in the feed direction from a position corresponding to the axes of the support shafts 30. Therefore, the push members 32*a* and 32*b* do not turn and hence the C ring strip 86 is pushed in the feed direction by the push members 32*a* and 32*b*.

When the trigger 14 is released in this state, the position of the directional control valve 10 changes from the position c via the position b to the position a to move the piston rod 58 of the feed pneumatic cylinder 56 forward. Consequently, the second swing member 42 is turned clockwise, as viewed in FIG. 4, against the resilience of the extension spring 74, the feed members 48*a* and 48*b* feed the C ring strip 86 in the feed direction by a distance corresponding to the thickness of the C ring 82. Subsequently, the first swing member 26 is turned counterclockwise, as viewed in FIG. 4, against the resilience of the compression spring 72 to move the push members 32*a* and 32*b* in the backward direction opposite the feed direction.

In a state where the trigger 14 is not pulled, the jaws 6 are turned away from each other, the feed members 48*a* and 48*b* feeds the C ring strip 86 by a distance corresponding to the thickness of the C ring 82, and then the push members 32*a* and 32*b* are moved in the backward direction opposite the feed direction. When the trigger 14 is pulled in this state, the jaws 6 are turned toward each other to fasten members together with the C ring 82, the feed members 48*a* and 84*b* are moved in the backward direction opposite the feed direction, and the push members 32*a* and 32*b* push the C ring strip 86 in the feed direction. When the trigger 14 is released in this state, the jaws 6 are turned away from each other, the feed members 48*a* and 48*b* feed the C ring strip 86 by a distance corresponding to the thickness of the C ring 82, and then the push members 32*a* and 32*b* are moved in the backward direction opposite the feed direction.

In a state where the magazine 4 is loaded with the C ring strip 86, the stopping part 68 of the stopper 66 is engaged in a recess between the adjacent C rings 82. Therefore, the C ring strip 86 can be restrained from movement in the backward direction opposite the feed direction. When the C ring strip 86 is moved in the feed direction, the C ring 82 on behind the stopping part 68 depresses the stopping part 68 and rides over the stopping part 68. Thus, the stopper 66 does not obstruct the forward movement, namely, movement in the feed direction, of the C ring strip 86. When the operator pushes up, as viewed in FIG. 4, the releasing part 70 with a fingertip, the stopping part 68 is moved down, as viewed in FIG. 4, and disengaged from the recess between the adjacent C rings 82 of the C ring strip 86 to enable the C ring strip 86 to move in the backward direction.

The push members 32*a* and 32*b* of the C ring fastening device pushes the C ring strip 86 in the feed direction after the feed members 48*a* and 48*b* have completed a feed operation for feeding the C ring strip 86 in the feed direction. Thus, the C ring fastening device is capable of surely feeding the top C ring 82 of the C ring strip 86 to a fastening position. The stopper 66 attached to the spring seat 60 restrains the C ring strip 86 from backward movement. Thus, the C ring strip 86 can be easily loaded into the magazine 4. The push members 32*a* and 32*b* each provided with the grooves 34 are pivotally supported on the push member holding parts 28 of the first swing member 26 and the side parts of the C rings 82 are engaged in the grooves 34. Therefore, the C ring strip 86 can be surely pushed in the feed direction. The feed members 48*a* and 48*b* each provided with the grooves 50 are pivotally supported on the feed member holding parts 44 of the second swing member 42 and the side parts of the C rings 82 are engaged in the grooves 50. Therefore, the C ring strip 86 can be surely fed in the feed direction.

Figure 9:
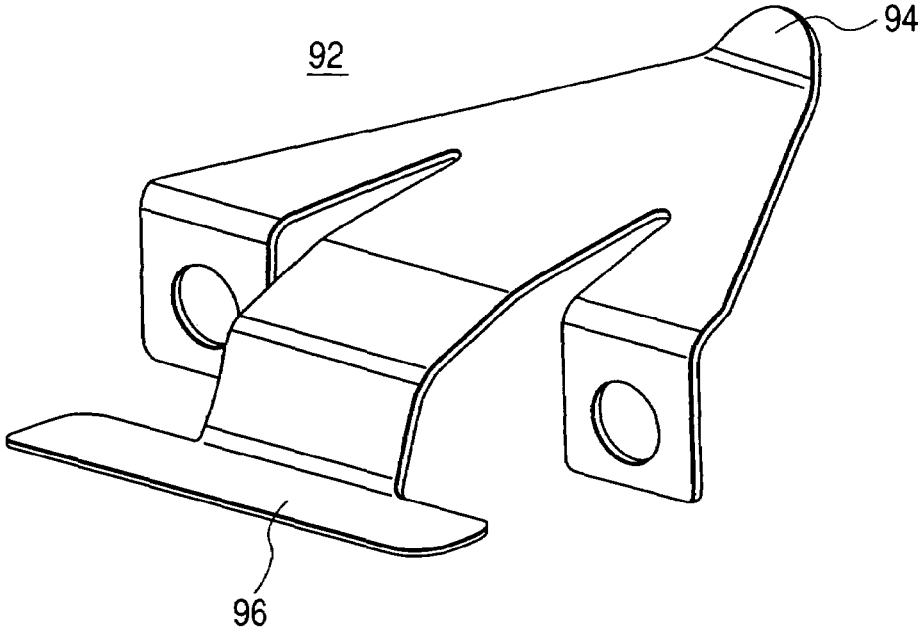
FIG. 9 is a perspective view of a stopper included in a C ring fastening device in a second embodiment according to the present invention.

FIG. 9 shows a stopper 92 included in a C ring fastening device in a second embodiment according to the present invention. The stopper 92 has a tapered stopping part 94 and a wide releasing part 96. The stopper 92, similarly to the stopper 66, is fastened to a spring seat 60 with screws 64. The wide releasing part 96 facilitates operator's pushing up the releasing part 96 with a fingertip.

Figure 10:
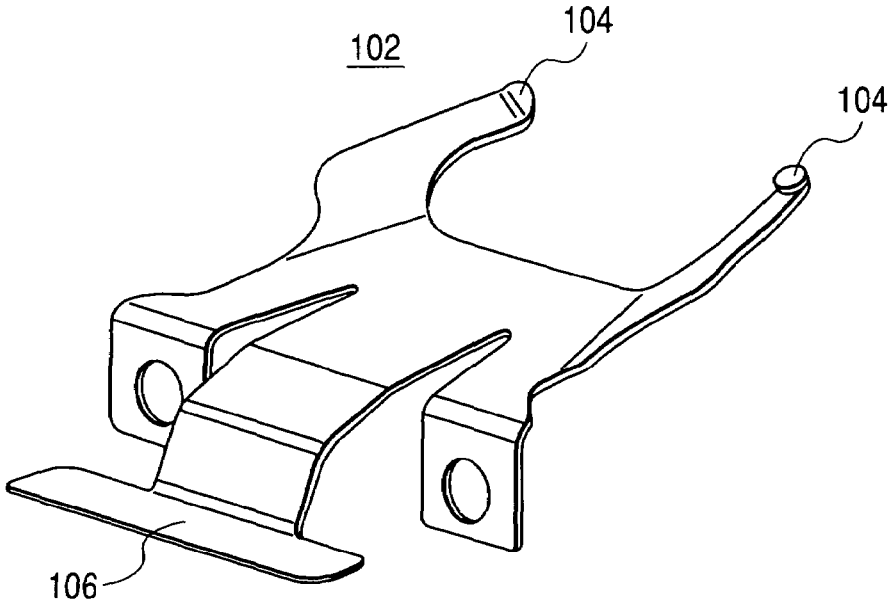
FIG. 10 is a perspective view of a stopper included in a C ring fastening device in a third embodiment according to the present invention.

FIG. 10 shows a stopper 102 included in a C ring fastening device in a third embodiment according to the present invention. The stopper 102 has two tapered stopping parts 104 and a wide releasing part 106. The stopper 102, similarly to the stopper 66, is fastened to a spring seat 60 with screws 64. The two stopping parts 104 are engaged in two recesses each formed between side parts of the adjacent C rings 82 of the C ring strip 86, respectively, to restrain the C ring strip 86 from moving backward with reliability. The wide releasing part 106 facilitates operator's pushing up the releasing part 106 with a fingertip.

Although the invention has been described as applied to the C ring fastening device, it is obvious that the present invention is applicable to hog ring fastening devices other than the C ring fastening device specifically described herein. In a modification, one of the two push members 32*a* and 32*b* may be omitted or one of the feed members 48*a* and 48*b* may be omitted. The C ring fastening device may be provided with push members other than the push members 32*a* and 32*b* each provided with the grooves 34. The C ring fastening device may be provided with feed members other than the feed members 48*a* and 48*b* each provided with the grooves 50.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A hog ring fastening device comprising:

a body member;

a magazine attached to the body member;

jaws pivotally supported on the body member;

a main pneumatic cylinder for turning the jaws;

a first swing member supported for turning on the body member;

a push means supported on the first swing member;

a feed pneumatic cylinder fixed to the first swing member and connected to a port of the main pneumatic cylinder;

a second swing member supported for turning on the body member so as to be in contact with a free end of a piston rod included in the feed pneumatic cylinder;

a feed means supported on the second swing member;

a spring seat fixed to the body member;

a compression spring extended between the spring seat and the first swing member; and an extension spring extended between the first and the second swing member.

2. The hog ring fastening device according to claim 1, wherein a stopper having a stopping part and a releasing part is attached to the spring seat.

3. The hog ring fastening device according to claim 1, wherein the push means is push members, and the push members are pivotally supported on push member support parts formed in end parts of the first swing member, and each of the push members is provided with a plurality of grooves.

4. The hog ring fastening device according to claim 3, wherein the push members are pivotally supported on support shafts attached to the push member support parts, respectively, and are energized by coil springs so as to turn toward each other.

5. The hog ring fastening device according to claim 4, wherein the grooves of the push members are parallel to axes of the support shafts respectively supporting the push members, and surfaces provided with the grooves of the push members are on an inner side of the axes of the support shafts, respectively and are displaced in a feed direction from a position corresponding to the axes of the support shafts.

6. The hog ring fastening device according to claim 1, wherein the feed means is feed members, and feed members are pivotally supported on feed member support parts formed in end parts of the second swing member, and each of the feed members is provided with a plurality of grooves.

7. The hog ring fastening device according to claim 6, wherein the feed members are pivotally supported on support shafts attached to the feed member support parts, respectively, and are energized by coil springs so as to turn toward each other.

8. The hog ring fastening device according to claim 7, wherein the grooves of the feed members are parallel to axes of the support shafts respectively supporting the feed members, and surfaces provided with the grooves of the feed members are on an inner side of the axes of the support shafts, respectively and are displaced in a feed direction from a position corresponding to the axes of the support shafts.

* * * * *